US007709725B2

(12) United States Patent
Toledano et al.

(10) Patent No.: US 7,709,725 B2
(45) Date of Patent: May 4, 2010

(54) ELECTRONIC MUSIC ON HAND PORTABLE AND COMMUNICATION ENABLED DEVICES

(75) Inventors: Eyal Toledano, Givat Ram K. Ata (IL); Natan Linder, Motza Illit (IL); Ytai Ben-Tsvi, Givatayim (IL)

(73) Assignee: Samsung Electronics Co., Ltd. (KR)

( * ) Notice: Subject to any disclaimer, the term of this patent is extended or adjusted under 35 U.S.C. 154(b) by 1036 days.

(21) Appl. No.: 11/031,027

(22) Filed: Jan. 7, 2005

(65) Prior Publication Data

US 2006/0130636 A1 Jun. 22, 2006

(30) Foreign Application Priority Data

Dec. 16, 2004 (IL) ..... 165817

(51) Int. Cl.
*G10H 1/00* (2006.01)

(52) U.S. Cl. ..... 84/615; 84/653; 84/600

(58) Field of Classification Search ..... 84/600–602, 84/615, 653

See application file for complete search history.

(56) References Cited

U.S. PATENT DOCUMENTS 4,257,306 A * 3/1981 Laflamme ..... 84/485 R
4,294,154 A * 10/1981 Fujisawa ..... 84/678
4,412,473 A * 11/1983 Laflamme ..... 84/485 R
4,519,044 A * 5/1985 Munetsugu ..... 708/134
4,982,643 A 1/1991 Minamitaka
5,151,873 A * 9/1992 Hirsh ..... 708/172
5,553,220 A * 9/1996 Keene ..... 345/520
5,646,648 A * 7/1997 Bertram ..... 345/168
6,075,998 A * 6/2000 Morishima ..... 455/567
6,094,587 A * 7/2000 Armanto et al. ..... 455/567
6,501,967 B1 * 12/2002 Makela et al. ..... 455/567
6,621,903 B2 * 9/2003 Oda ..... 379/374.01
6,969,794 B2 * 11/2005 Suzuki ..... 84/600
7,009,942 B2 3/2006 Fujimori et al.
7,012,185 B2 * 3/2006 Holm et al. ..... 84/645
7,069,058 B2 * 6/2006 Kawashima ..... 455/567
7,071,403 B2 * 7/2006 Chang ..... 84/645
7,167,725 B1 * 1/2007 Nakamura et al. ..... 455/557

(Continued)

FOREIGN PATENT DOCUMENTS

JP 05-027750 2/1993

(Continued)

OTHER PUBLICATIONS

Hujimoto Ken, Cubase VST for Windows, Japan, Rittor Music Inc., Dec. 31, 2000.

(Continued)

*Primary Examiner*—David S. Warren
(74) *Attorney, Agent, or Firm*—The Farrell Law Firm, LLP

(57) ABSTRACT

A portable electronic device having a screen and a numeric keypad, comprises: a sound card for processing sound signals to produce musical tones; a musical synthesizer, associated with said sound card, for electronically synthesizing musical instruments; and a user interface for interfacing said musical synthesizer to a user via said screen and said numeric keypad. The device can be a cellular telephone and may be able to interact with other devices.

14 Claims, 16 Drawing Sheets

U.S. PATENT DOCUMENTS

| | | | | |
|---|---|---|---|---|
| 7,196,260 | B2 * | 3/2007 | Schultz | 84/613 |
| 7,197,149 | B1 * | 3/2007 | Mita et al. | 381/98 |
| 7,233,659 | B1 * | 6/2007 | Davis et al. | 379/388.03 |
| 7,259,311 | B2 * | 8/2007 | Ashida | 84/454 |
| 2001/0047717 | A1 * | 12/2001 | Aoki et al. | 84/611 |
| 2002/0073827 | A1 * | 6/2002 | Gaudet | 84/478 |
| 2002/0107803 | A1 * | 8/2002 | Lisanke et al. | 705/51 |
| 2002/0197993 | A1 * | 12/2002 | Cho et al. | 455/435 |
| 2003/0013497 | A1 * | 1/2003 | Yamaki et al. | 455/567 |
| 2003/0128834 | A1 * | 7/2003 | Laine | 379/374.01 |
| 2003/0133700 | A1 | 7/2003 | Uehara | |
| 2004/0142680 | A1 * | 7/2004 | Jackson et al. | 455/412.1 |
| 2004/0154460 | A1 * | 8/2004 | Virolainen et al. | 84/645 |
| 2004/0154461 | A1 * | 8/2004 | Havukainen et al. | 84/645 |
| 2004/0173082 | A1 * | 9/2004 | Bancroft et al. | 84/612 |
| 2004/0176025 | A1 * | 9/2004 | Holm et al. | 455/3.06 |
| 2004/0264391 | A1 * | 12/2004 | Behboodian et al. | 370/276 |
| 2005/0107075 | A1 * | 5/2005 | Snyder | 455/418 |
| 2005/0107128 | A1 * | 5/2005 | Deeds | 455/567 |
| 2006/0011044 | A1 * | 1/2006 | Chew | 84/609 |
| 2006/0027080 | A1 * | 2/2006 | Schultz | 84/613 |
| 2006/0085343 | A1 * | 4/2006 | Lisanke et al. | 705/50 |
| 2006/0105818 | A1 * | 5/2006 | Andert et al. | 455/569.1 |
| 2006/0137513 | A1 * | 6/2006 | Billon et al. | 84/600 |
| 2006/0180006 | A1 * | 8/2006 | Kim | 84/609 |
| 2006/0230908 | A1 * | 10/2006 | Lee et al. | 84/609 |
| 2006/0230909 | A1 * | 10/2006 | Song et al. | 84/609 |
| 2006/0230910 | A1 * | 10/2006 | Song et al. | 84/616 |
| 2007/0012167 | A1 * | 1/2007 | Bang et al. | 84/723 |
| 2007/0026844 | A1 * | 2/2007 | Watanabe | 455/412.1 |
| 2007/0186750 | A1 * | 8/2007 | Zhang | 84/609 |
| 2007/0199432 | A1 * | 8/2007 | Abe et al. | 84/645 |
| 2007/0283799 | A1 * | 12/2007 | Carruthers et al. | 84/645 |
| 2008/0047415 | A1 * | 2/2008 | Schultz | 84/723 |

FOREIGN PATENT DOCUMENTS

| | | |
|---|---|---|
| JP | 2615721 | 3/1997 |
| JP | 11-175061 | 7/1999 |
| JP | 11-352969 | 12/1999 |
| JP | 2000-029463 | 1/2000 |
| JP | 2001-142388 | 5/2001 |
| JP | 2001-195067 | 7/2001 |
| JP | 2001-203732 | 7/2001 |
| JP | 2002-156982 | 5/2002 |
| JP | 2002-200338 | 7/2002 |
| JP | 2003-208169 | 7/2003 |
| JP | 2004-341385 | 12/2004 |

OTHER PUBLICATIONS

CUBASE VST detail, Japan, Dec. 31, 2000.
MIDI Bible II MIDI 1.0 Standard Practical-Use Version, Japan, Rittor Music Inc., Mar. 30, 1998.

* cited by examiner

ELECTRONIC MUSIC ON HAND PORTABLE AND COMMUNICATION ENABLED DEVICES

PRIORITY

This application claims priority to an application entitled "ELECTRONIC MUSIC ON HAND PORTABLE AND COMMUNICATION ENABLED DEVICES", filed in the Israel Patent Office on Dec. 16, 2004 and assigned Ser. No. 165817, the entire contents of which are incorporated herein by reference.

FIELD AND BACKGROUND OF THE INVENTION

The present invention relates to electronic music on hand portable and communication enabled devices and, more particularly, but not exclusively to electronic music on PDA and cellular type devices. PDA and cellular devices with musical ability are available. Such devices have sound card capabilities that enable them to play high quality musical notes and they are able to play music files, for example ring tones, or allow a user to enter his own ringtone via the keyboard.

A major limitation with such electronic devices is the limited resources. Both permanent and temporary memory are severely limited as compared with desktop or laptop computers, and the musical ability must not interfere with the other activities of the device, for example its communication abilities. Thus an add-on feature such as music should not exceed resource requirements as follows: ROM should be limited to about 20 MB (including built-in content), and RAM usage should be limited to about 8 MB of dynamic RAM.

Another consideration is power consumption—sound hardware consumes a relatively large amount of battery power. Any sound hardware should be kept in a sleep mode whenever possible in order to conserve battery power. It is expected that a full battery could be emptied by about 1-2 hours of sound playback.

Due to these limitations, the utilization of the sound card has generally been limited. Users are able to play and set up ring tones but nothing much larger, and the ability to set ring tones allows the user nothing more than to play a set of tones. The communication ability of the cellular device is used solely to download such ringtone files.

In general a musical product is wanted that is simple for a beginner to use, but that also satisfies the requirements of the more sophisticated user. In this case the sophisticated user is a user with a good musical background, often one who can play a musical instrument or has a knowledge of musical theory. In particular the product should produce better results for the advanced user, and for the beginner should be expected to produce steadily better results the more the product is used.

There is thus the overall feeling that the full capabilities of the cellular device are not being fully utilized.

SUMMARY OF THE INVENTION

According to one aspect of the present invention there is provided a portable electronic device having a screen and a numeric keypad, the device includes a sound card for processing sound signals to produce audible musical tones at an audible output of the device; a musical module, associated with the sound card, for electronically synthesizing musical instruments; and a user interface for interfacing the musical module to a user via the screen and the numeric keypad, the user interface being configured to set a user play mode in which input at the numeric keypad is played as audio output via the sound card.

Preferably, the musical module is a musical synthesizer.

Preferably, the musical synthesizer is a software synthesizer.

Additionally or alternatively, the musical synthesizer is a hardware device.

Preferably, the user interface is configured to set a play back mode, in which data, from a stored music file or from a communication channel, is played as audio output via the sound card.

Preferably, the user interface is configured to set a record mode in which input at the numeric keypad is played as audio output via the sound card and recorded in data storage.

Preferably, the user interface is configured to set a play and record mode in which data from a stored music file is played as audio output via the sound card and input at the numeric keypad is also played as audio output together with the data from the stored music file.

The device may further include a parameter extractor for extracting musical parameters of the stored music file; and a constraint unit associated with the parameter extractor for setting ones of the extracted musical parameters of the stored music file as constraints for the user input, thereby to bring about an automatic fit between the user input and the stored music file.

Preferably, the parameter extractor is configured to obtain the musical parameters of the stored music file from metadata associated with the file.

Preferably, the parameter extractor is configured to obtain the musical parameters of the stored music file from an event list within the file.

Preferably, the user interface comprises a layered menu, respective layers comprising selections at one level between at least two of record, user play and playback modes, selections at a second level between a plurality of musical instruments to be synthesized, or a plurality of stored files to be played, selections at a third level between standalone play and grouping with other devices, selections at a fourth level between musical keys or musical timings, and selections at a fifth level between musical notes in a selected musical key.

Preferably, the numeric keyboard is configured with key strike detection that is able to detect velocity of a key strike event, and wherein the musical module is able to use the velocity as a control parameter.

The device may comprise a cellular communication channel.

Preferably, the music file is a ring tone file.

According to a second aspect of the present invention there is provided a method of combined playing and editing of a track-based music file comprising a plurality of tracks, the method including the step of playing the music file in a repetitive loop; at one of the loops adding musical material to one of the plurality of tracks;

at subsequent ones of the loops playing the plurality of tracks including the one track with the added musical material.

Preferably, the playing and editing comprises reading existing tracks of the file for playing and clearing an additional track for the adding.

Preferably, the reading is carried out at an advancing reading position and the adding is carried out at an advancing adding position and wherein the adding position is behind the reading position.

Preferably, the music file is an event stream file.

Preferably, the adding the musical material comprises setting a musical instrument and entering musical notes via a numeric keypad.

The method may comprise a stage of obtaining at least one of a musical key and musical timing for constraining the adding the musical material, by analysis of the music file.

Preferably, the analysis comprises analyzing metadata stored with the music file.

Preferably, the analysis comprises analyzing an event stream of the music file.

The method may comprise an initial stage of receiving the track-based file over a communication channel.

The method may comprise a subsequent stage of sending the track-based file with the added musical material over a communication channel.

According to a third aspect of the present invention there is provided a portable electronic apparatus for playing and editing of a track-based music file comprising a plurality of musical tracks, the apparatus includes a loop based player unit for playing tracks of the music file in a repetitive loop; and an editing unit, associated with the loop-based player unit; for adding musical material to a selected one of the plurality of tracks whilst playing in one of the repetitive loops, and wherein further repetitive loops of the music file include the selected one of the plurality of tracks with the added musical material.

Preferably, the editing unit is operable to delete existing material from the selected one of the plurality of tracks prior to the adding.

Preferably, recording is carried out at a virtual record head and playing is carried out at a virtual play head and wherein the virtual record head is temporally behind the virtual play head during the playing and editing.

Preferably, the music file is an event stream file.

The apparatus may further comprise a numeric keypad and a screen, and the adding the musical material comprises setting a musical instrument and entering musical notes via the numeric keypad and the screen.

The apparatus may comprise a constraint unit configured to obtain at least one of a musical key and musical timing for constraining the adding the musical material, by analysis of the music file.

Preferably, the analysis comprises analyzing metadata stored with the music file.

Preferably, the analysis comprises analyzing an event stream of the music file.

The apparatus may comprise a communication channel able to receive the track-based file from a remote location and to send the track-based file with the added musical material over a communication channel.

According to a fourth aspect of the present invention there is provided a portable electronic apparatus for playing a music file and allowing a user to input musical material, the apparatus includes a play unit for playing music from data, including user input musical material and music file data; a parameter extractor for extracting musical parameters of the music file; a user input unit, for receiving the user input musical material, and a constraint unit associated with the parameter extractor and the user input unit, for setting ones of the extracted musical parameters of the music file as constraints for the user input, thereby to achieve at least one of playing and recording of the user input musical material in accordance with the constraints.

Preferably, the parameter extractor is configured to read metadata associated with the music file to extract the musical parameters therefrom.

Preferably, the parameter extractor is configured to infer the musical parameters from an event stream of the data file.

The apparatus may comprise cellular communication functionality for receiving input music files and for sending music files after augmentation by the constrained user input.

According to a fifth aspect of the present invention there is provided a portable electronic device includes music playing capability for playing music from electronic storage or from a communication channel or from user input; and a grouping capability for allowing the device to synchronize itself with at least one other device; and group playing capability, associated with the grouping capability and the music playing capability, for allowing the device to play music from the communication channel together with music from the user input in synchronized manner.

Preferably, the group playing capability comprises adding a delay of at least one cycle to overcome latency of the communication channel.

The device is preferably configured such that the user input is transmitted over the communication channel to be available at the at least one other device for a subsequent time period.

Preferably, the subsequent time period is an immediately following time period.

Preferably, the grouping capability comprises group mastering capability for forming the group and controlling the synchronizing.

Preferably, the grouping capability is configurable to operate as a slave to a remotely located master device to synchronize therewith.

The device may comprise a display screen and comprising a representation capability for providing indications of other devices of the group as icons on the screen.

Preferably, the icons are animated icons.

The device may comprise a feedback unit for analyzing the user input to provide a respective user with feedback on his musical playing.

Preferably, the feedback unit is configured to analyze the user input as an event stream.

According to a sixth aspect of the present invention there is provided a musical content input system for a portable electronic device, the system includes a motion detector for detecting motion parameters of the portable electronic device, a user input unit, for receiving user input musical material, and a constraint unit associated with the motion detector and the user input unit, for using the motion parameters to define musical generation parameters to modify the user input, thereby to allow the portable electronic device to play the user input musical material according to the parameters.

Preferably, the motion detector is part of an integrally mounted camera.

According to a seventh aspect of the present invention there is provided a portable electronic device includes an audio input, an electronic musical synthesizer having a plurality of instrument modes each for synthesizing a different musical instrument, and an additional mode for the electronic musical synthesizer in which clips obtained from the input are used as a device-defined instrument.

The device may comprise a categorizer for categorizing and storing the clips from the input using musical qualities of the clips.

Preferably, the categorizer is preceded by a musical analyzer for identifying musical qualities of material from the audio input.

Preferably, the categorizing comprising arranging clips with different notes into a customized instrument.

The device may comprise an autonomous software unit for autonomously carrying out recording at the audio input.

Preferably, the autonomous software unit is associated with the musical analyzer to use analyzing properties thereof to decide whether to store or discard a given audio recording.

The device may comprise a camera input for taking images and storing the images within the device, and wherein the additional mode comprises a function for adding stored images to a music file of the device-defined instrument.

The device may comprise an autonomous software unit for operating the camera input for the taking of images.

The device may comprise a video camera input for taking video images and storing video image clips within the device, and wherein the additional mode comprises a function for adding the stored video image clips to a music file of the device-defined instrument.

The device may comprise an autonomous software unit for operating the video input.

The device may comprise a pattern mode for composing music according to a prestored pattern.

The device may comprise an artificial learning module for monitoring musical activity on the device and using monitoring results for modifying the prestored pattern.

According to an eighth aspect of the present invention there is provided a method of editing a music file comprising at least one track on a portable electronic device, the method including the steps of playing the track on the portable electronic device, and simultaneously with the playing using an interface of the portable electronic device to edit the track.

Preferably, the music file is a multi-track file.

Additionally or alternatively, the music file is a ring tone file.

Preferably, the portable electronic device is a cellular communication enabled device configured to receive and transmit the music file.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
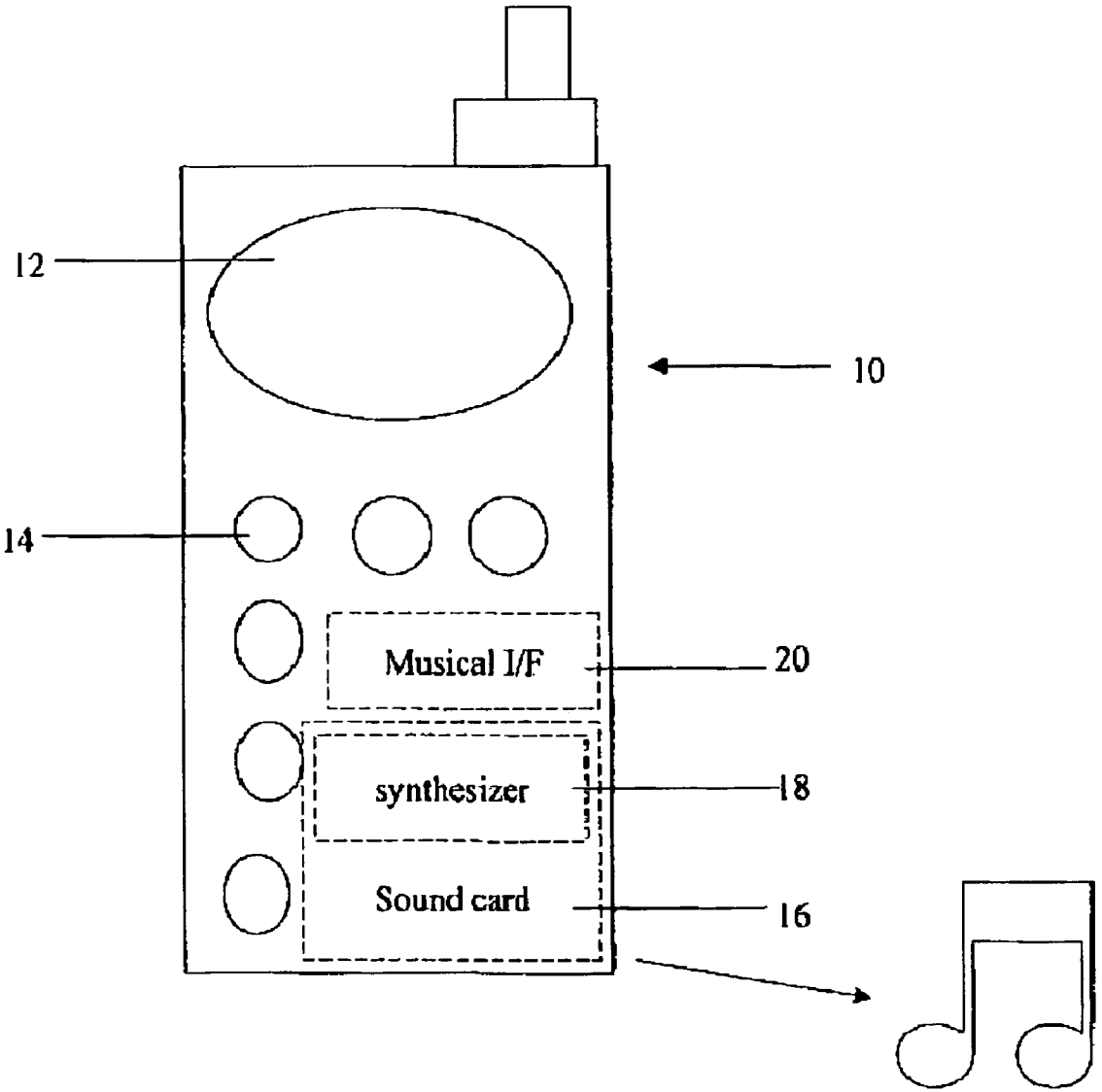
FIG. 1 is a simplified diagram showing a portable electronic device according to a first preferred embodiment of the present invention.

The present embodiments comprise a portable electronic device such as a mobile telephone or PDA or the like having musical capabilities and an interface for allowing the user to make elementary or sophisticated use of the musical capabilities. In a further preferred embodiment the device is capable of working in a group with other devices in a musical version of a conference call.

The principles and operation of a portable electronic device with a musical interface according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1, which illustrates a portable electronic device 10 according to a first preferred embodiment of the present invention. Device 10 has a screen 12 and a numeric keypad 14. The device further includes a sound card 16 for processing sound signals to produce musical tones and which is connected to the device speaker to output music. The device further includes a musical module 18, possibly a synthesizer, which works with the sound card, and which is able to electronically synthesize a range of musical instruments. The musical module may be software, hardware or firmware as most convenient. The musical module may be part of the sound card. That is to say it is able to reproduce musical tones in the style of each of a number of instruments that are stored in its memory. The device 10 further comprises a user interface 20 for interfacing the musical synthesizer to a user via the screen and the numeric keypad, so that the musical abilities of the device are easy to use, as will be explained below.

Figure 2:
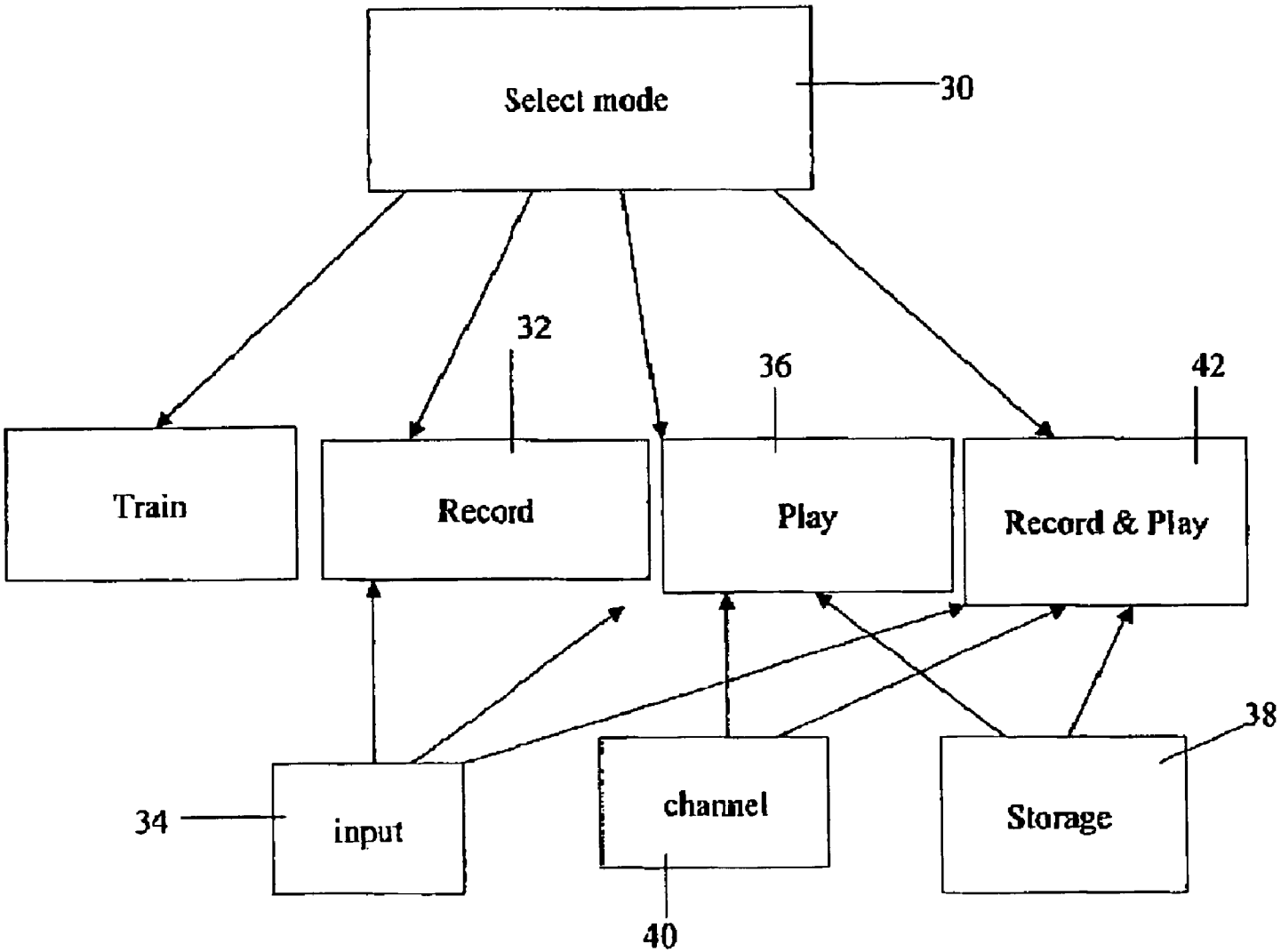
FIG. 2 is a simplified diagram illustrating a number of use states or modes of the user interface of the device of FIG. 1.

Preferably, the user interface is configured to allow the user conveniently to set a number of modes for using the synthesizer and the musical properties of the device. Reference is now made to FIG. 2, which illustrates a number of basic use states that the interface provides. A mode select state 30 leads to a record mode 32 which records user input 34 via the keyboard. A playback mode 36 plays files from storage 38 or from the cellular channel 40. A play and record mode 42 records user input at the same time as playing a file.

Play and record mode operates as follows: There exist N "background tracks" and M "user tracks" at any given moment. The user tracks are initially empty. All tracks are played repetitively simultaneously at all times. Background tracks contain background music which is a part of the song and are never changed. Each of the user tracks is associated with an instrument, which determines how notes in this track will sound. At any given moment, there is one user track which is designated as the "active track". When in play mode (not recording), the only thing that the active track influences is that when pressing the keypad keys, the notes that result are played with the instrument of the active track. When pressing the record key, it is the active track that gets armed for recording, and the telephone enters "record standby" state. As soon as the cycle ends, several thing happen: the telephone enters the "recording" state, the current track becomes "armed" for recording, and the entire sequence it contains is cleared. From this moment and until the end of the cycle, all the user's action are recorded for storage in the active track. When the cycle ends, the system returns to a non-recording state, unless the record key has been pressed during this cycle. In the latter case, the system acts again as if entering the record state.

Typical operation of the system usually involves: selecting an active track, recording something to the track, switching to another track, recording another thing to be playing with the first and with the background music, and so forth. During the process we may sometimes wish to change the content of an existing track rather than adding to it, and in that case, one simply re-records into the same track, since as stated above, the track is cleared as soon as recording to it starts.

Figure 3:
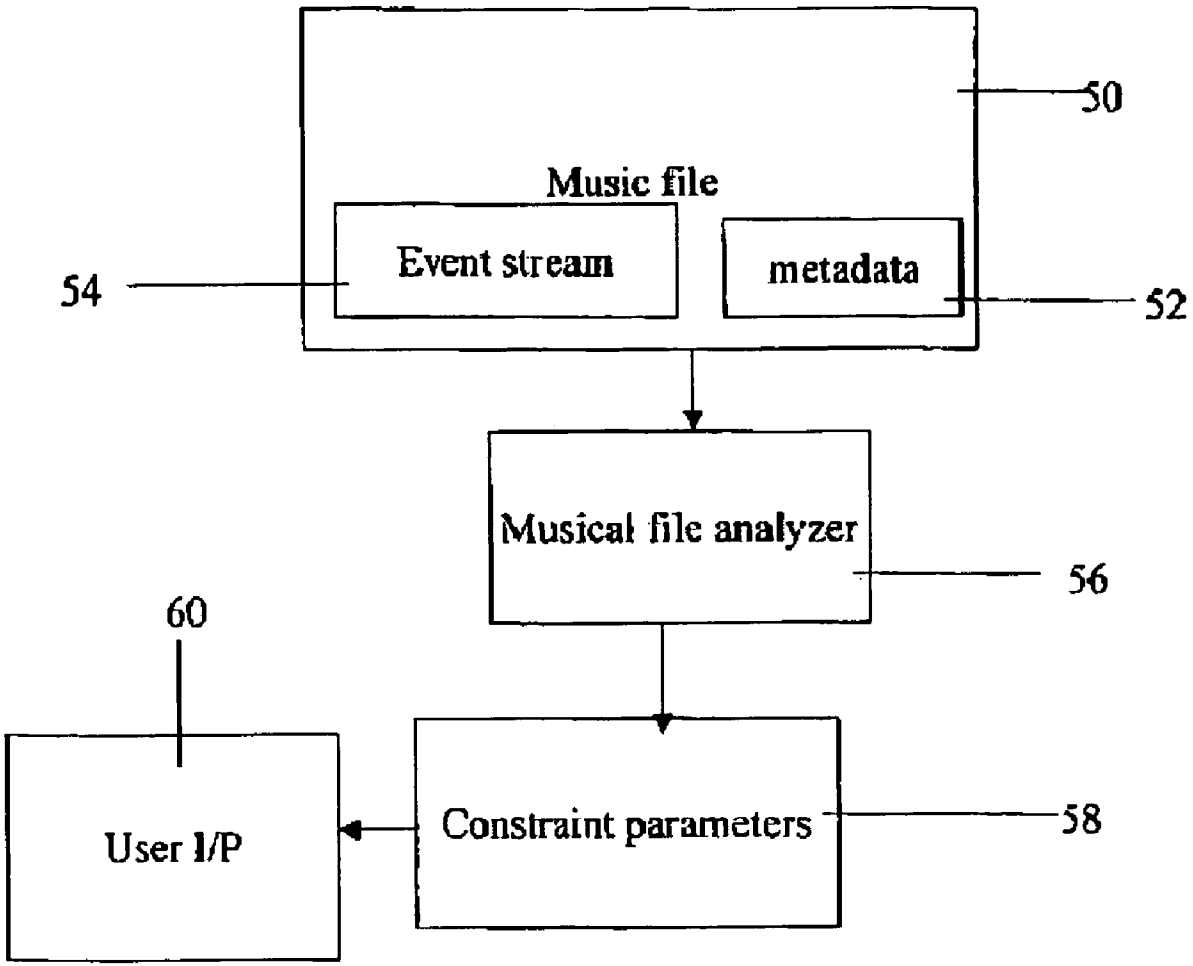
FIG. 3 is a simplified block diagram illustrating an implementation allowing music files to be analyzed, according to a further preferred embodiment of the present invention.

Reference is now made to FIG. 3, which is a simplified diagram illustrating a particularly preferred feature of the play and record mode 42. In FIG. 3 a music file 50 is selected as background music or as a file to be recorded on. The file is played and also analyzed. Analysis may be of metadata 52, or of an event list 54 that makes up the file content, say of a MIDI file. The analysis is carried out by musical file analyzer 56. File analyzer 56 essentially acts as a parameter extractor and a constraint unit. That is to say the file analyzer 56 is configured to extract parameters from the file such as timing information such as synchronization and beat information, style information such as light rock, heavy rock, Celtic, and the like, and instrument information. The extracted parameters 58 are then used to constrain the user input 60, meaning that the user input is given default selections to match the background music. Thus the default beat is that of the background music. The default style is that of the background music, the input is automatically synchronized to the background music and the like. In other words the result is to bring about an automatic fit between the user input and the stored music file, so that even for a relatively unsophisticated user his input integrates with the background.

Figure 4:
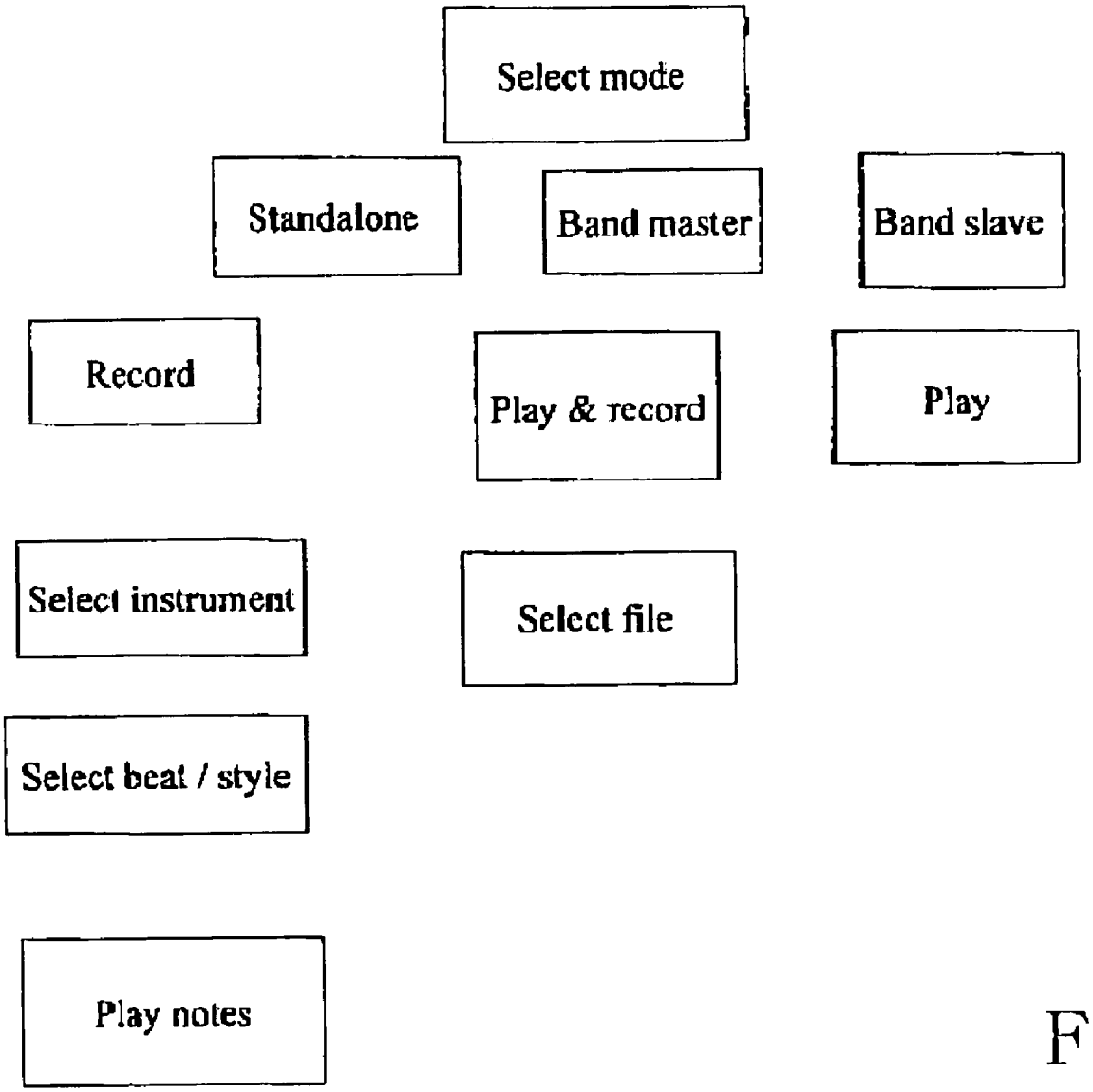
FIG. 4 is a simplified schematic diagram illustrating a layered menu screen for the user interface of the device of FIG. 1.

Reference is now made to FIG. 4 which is a simplified diagram illustrating a layered menu screen for the different functions available in the user interface. The various layers include one level that allows selection between standalone and band modes, another level that allows selection between record, play-record and playback modes. A third selection allows for a choice at a second level between a plurality of musical instruments to be synthesized, or a plurality of stored files to be played. Selections are also available between musical keys or musical timings, and selections between musical notes in the selected musical key.

In a preferred embodiment of the present invention the numeric keyboard is configured with key strike detection that is able to detect velocity of a key strike event, so that the telephone keypad has all of the properties of a MIDI keyboard, and the synthesizer is able to obtain the velocity information and use it to modify the generated note.

When recording music over a background track, one way of using the interface is to enter the play and record mode and set a given file as the background music which is playing. The track may then be played in a repetitive loop, and during the loop user input is added to the track, whilst being echoed to the sound card. At subsequent loops the track is played with the added material. In one embodiment, the music file is an event stream type of file such as a MIDI file, rather than a waveform type of sound representation file such as the WAV type file. An advantage of the event stream type file is that an event stream is much easier to analyze for musical parameters than a waveform and therefore is much easier to carry out within the limited resource availability of the cellular device. In an alternative embodiment analysis of the file is carried out offline.

Preferably, adding the musical material comprises setting a musical instrument and other parameters as necessary and entering musical notes via a numeric keypad, as explained above.

Figure 5:
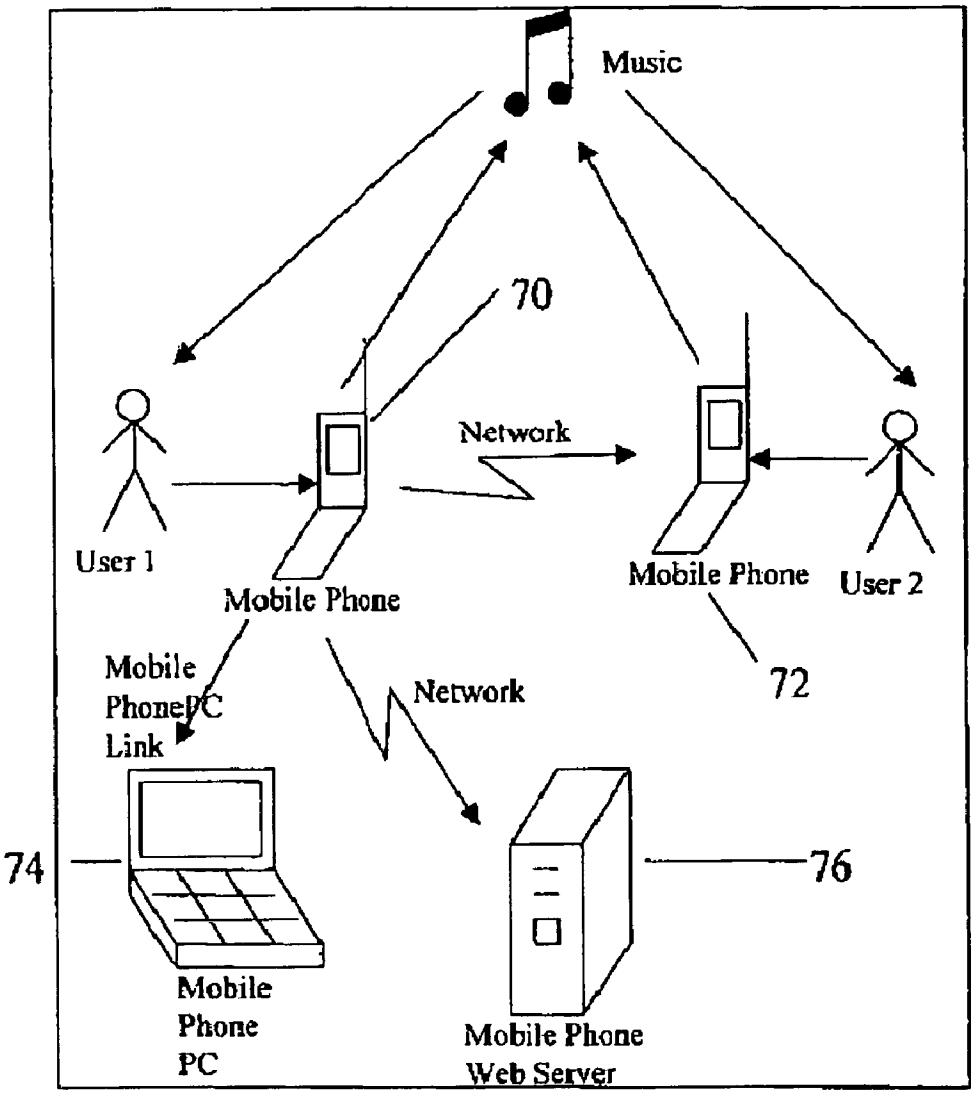
FIG. 5 is a simplified diagram illustrating the concept of group operation of the device of FIG. 1.

Reference is now made to FIG. 5, which is a simplified diagram illustrating an embodiment of the present invention in which music-enabled telephony devices are able to operate in groups. A first user with mobile device 70 sets up a group with other users such as a second user with mobile device 72. Mobile device 70 is able to connect via a PC link to PDA 74 and or to a web server 76 via a network link. Network and PCLink both serve two purposes, as follows:

1. Content provisioning—transfer of electronic music files between users, from Web sites to users, and from user's PC to user's mobile device.

2. Playback synchronization for both users using the mobile version of electronic music and users using a desktop version.

The server or PC may optionally be used to support the group, depending on the way in which the group is set up, as will be described in greater detail below.

The link can be used to transfer instrument files. In a preferred embodiment of the present invention, instruments are represented by electronic files, each of which contains the information about the sound of each note in the given instrument. An instrument manager provided on each device is a file manager that manages the instrument files. For example the instrument manager shows a list of currently installed instruments to the user, and allows the user to delete or rename instruments. The user can add new instruments, either by defining a note set himself, as will be described in greater detail below or by downloading via the network or via a PC link.

The portable electronic device 70 comprises music playing capability for playing music from electronic storage or from a communication channel or from user input as explained above. It also includes a grouping capability which allows itself to be grouped with other devices over a communication channel. For the purposes of playing music the devices are preferably able to synchronize themselves over the communication channel. As a result there is formed a group playing capability, which enables the individual devices to play music from the communication channel together with music from the user input in synchronized manner. The input made at the local device is then transmitted to the other devices in the group. Due to latency in the transmission channel the input at a given device is not available to the other devices in the group until the beginning of the next cycle so that the group members cannot hear the results of the group session until later. Nevertheless, as all the users are synchronized, since all the players play loop-based music, and all play in the same scale and time base, the effect of a band or orchestra can be obtained, albeit not in real time. Using the group playing capability, each group member can listen to a background track and play along therewith, and his user input can then be added to the input of the other members of the group to form a compilation. The group synchronization signals can be used during compilation to ensure that the group compilation observes correct timing, but may not be needed except for new tracks.

One of the devices in the group is set up as a master. The master device is the device that controls synchronization and is the default device for setting the background music or for making any other settings that are needed for the group session. The master device invites the other devices to participate in the group or the other devices apply to join by calling the master or by calling a preset number. Technically the group session is similar to setting up a conference call and thus any of the techniques available for conference calls are available to the skilled person to enable the group session. For example the support necessary for the group can be provided on a dedicated server such as server 76, or from one of the devices themselves. The other devices operate in the session as slaves, responding to the synchronization and other signals set by the master. In the group session the master preferably defines what item is to be played, what parts the different group members are to play and in addition acts as conductor, bringing in the various parts as required. It is of course possible that one device can be the master and yet assign tasks such as conducting to other group members as desired. Alternatively a freeform version could be used in which a conductor is dispensed with.

Preferably, the devices can set themselves into a do-not-disturb mode so that they cannot be called during a concert.

In a preferred embodiment, the portable electronic device, which typically has a display screen, supports a representation capability for showing other group members, or players, as icons. The icons may for example show the instrument assigned to the given player. The icons can be animations and may for example indicate activity of the given group member. Thus a group member whose part does not require him to play at a given time may be shown inactive. Active members may be shown playing their assigned instruments etc. Outside of group activity, animations may be used to dance according to a currently set musical style or indicate a rhythm, and the like.

In one preferred embodiment, the portable device comprises a feedback unit or personal tutor, for analyzing the user input to provide feedback on his musical playing. The feedback unit may be incorporated in the portable device as such or may be available over the network, say via the PC link or network link. The feedback unit may compare the notes played by the user to a target sequence or may comment on the timing, tempo or scale and the like. The feedback unit may achieve this in one embodiment by analyzing the user input as an event stream. Analyzing an event stream is well within the capabilities of the limited resources of the mobile device whereas analyzing audio waveforms is more difficult and probably requires at least a PC. Analysis may be as simple as comparing the user note sequence to a target note sequence provided along with the song file. The target note sequence may have been deliberately provided in order to teach the user to play a specific song. In an alternative, or more complex embodiment, analysis may involve checking "musical correctness" of a user's autonomous creation. The user can, in either case, be graded according to his performance, along with textual commentary. The feedback unit preferably gives the user visual or audio feedback in real time, and in one preferred embodiment user performance can in fact be corrected before adding the newly added user part to the looped sequence, for example using time quantization or pitch quantization to scale degrees.

It is pointed out that the personal tutor is relevant to any of the embodiments herein, not just to the group-playing feature.

The training session can appear in the form of a game: the machine plays a sequence, and the user has to repeat the sequence, based on hearing and visual content, thus notes and other representations. Whenever the user succeeds, he is allowed to move on to the next sequence. Whenever he fails, he gets a message with tips for improvement and gets the same sequence again. All of the above process happens while background music is playing continuously, and the process of training itself creates one long piece of music that comprises a combination of the machine and user sequences. There is no need to stop during the session. The entire process is carried out "on-the-fly".

For evaluation purposes of the user sequence against the target sequence, two alternative embodiments are provided:

Calculation of total error energy compared to total signal energy:

If we compare the user sequence to the target sequence at a given instant, we can compare the set of notes that we expect to be playing at that instant with the notes actually playing. The size of the difference between the expected and actual sets is referred to as the "instantaneous error". If we integrate the instantaneous error over time a metric is obtained which represents the total sequence error. We can than divide the total signal energy (integral of the size of the target set over time) in the sum of the signal energy and the error energy, to get a number between 0 and 1 which represents the "similarity" between the target sequence and the user sequence. In practice, calculating such an integral reduces to a simple sum—so implementation is relatively easy.

Calculation of a minimum edit distance:

This method is more complex than the first but provides the ability to give feedback to the user, hence giving the user a better insight as to the reason for the error. The method involves computing a so-called "minimum edit distance" using the Levinstein algorithm, disclosed in U.S. Pat. No. 6,073,099, filed Nov. 4, 1997, the contents of which are hereby incorporated by reference. In the present case the string characters for the algorithm are musical notes, each note having 3 attributes: pitch, start time, and duration. The metrics to be used are the cost of adding an extra note, the cost of skipping a note, and the distance between two notes, computed by a formula which takes into account all three attributes of the note, with different weights for each one of them. Generally timing errors are given much less weight than pitch errors. If the minimum edit distance is too large—the system concludes that the user played the wrong sequence of notes, provides feedback to the user to guide him to play the correct notes. The system is able to show him exactly where he went wrong. If the edit distance is fairly small, the system checks the total timing error, by accumulating the square of the difference in time/duration between each two paired notes: the target note and the actual note. The pairing to be used is a by-product of the Levinstein algorithm: and each two notes that are considered for a replacement operation are a pair. We may then provide the user with feedback on his timing and duration accuracy, e.g. to output a message stating "You played the right notes, but please pay more attention to tempo".

Figure 6:
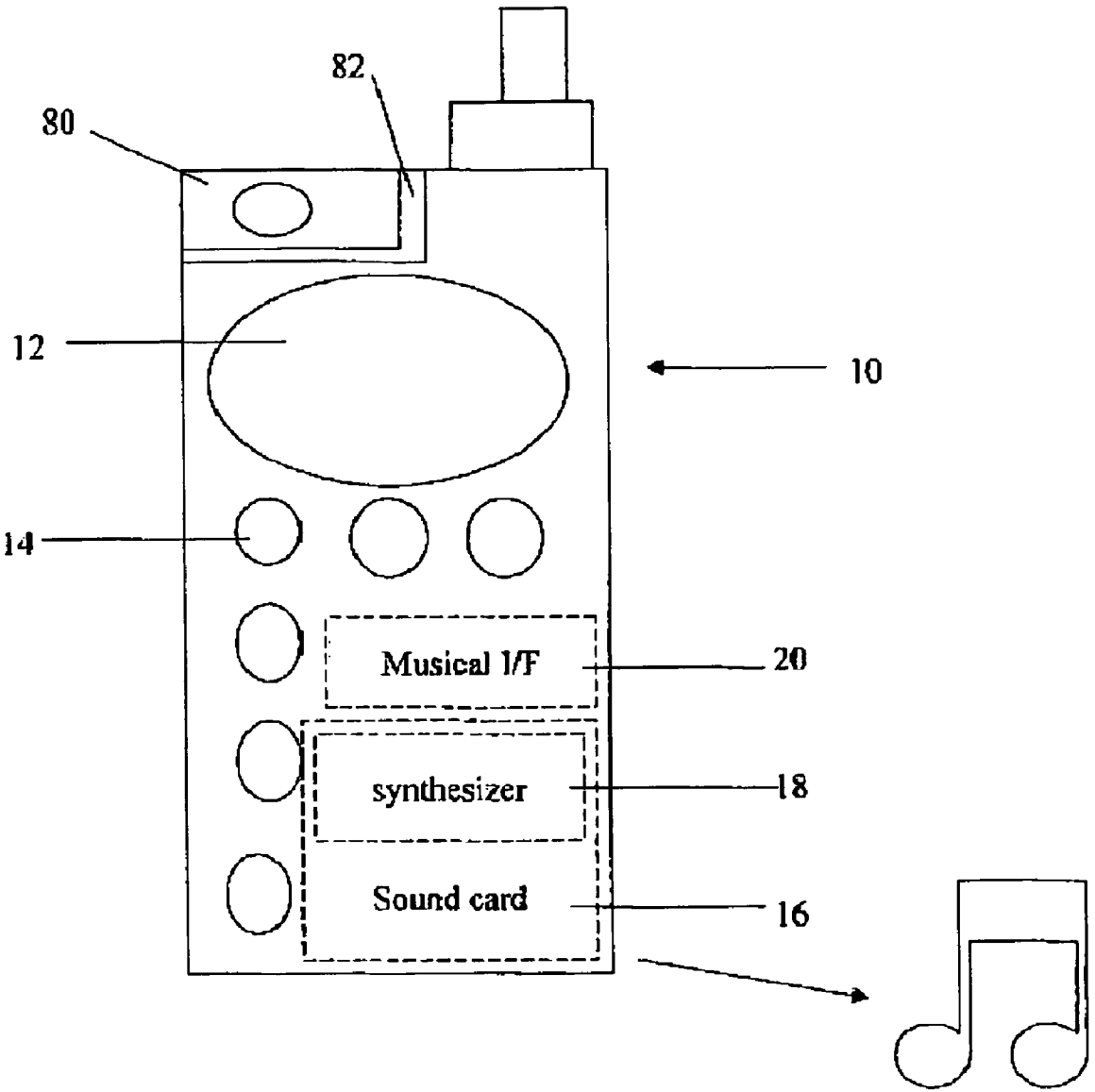
FIG. 6 is a simplified diagram illustrating a modification of the device of FIG. 1 to have a camera and associated motion detector.

Reference is now made to FIG. 6, which is a simplified diagram illustrating a further embodiment of the present invention in which additional detectors on the portable electronic device are used in order to set music generation parameters for influencing musical input. Parts that are the same as in previous figures are given the same reference numerals and are not referred to again except as necessary for understanding the present embodiment. In FIG. 6 a mobile telephony device has a camera 80. The camera may in some embodiments include a motion detector 82 which is provided for the various needs of the camera, for example to reduce the exposure time if the camera is moving. In one embodiment for use with video cameras the motion detector may be provided in software, and such a detector is part of the MPEG scheme. However the motion detector 82 produces signals which can be used by the music system for setting control parameters for music generation. For example the user may shake the mobile telephone at a given rate which the motion detector can determine, and the rate may be used to set the beat for the current input. Alternatively the output of the motion detector can be used to set the volume or any other parameter.

Figure 7:
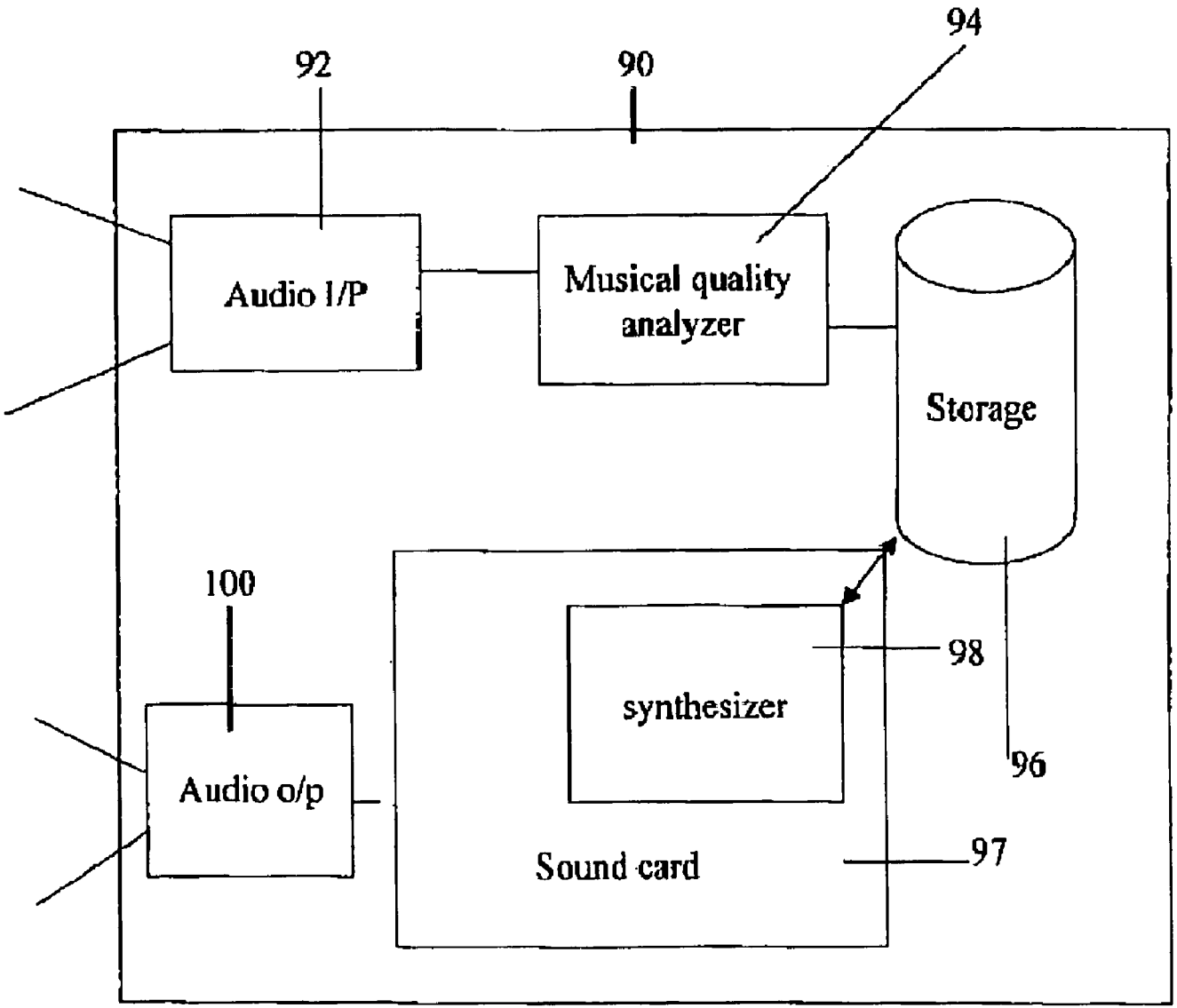
FIG. 7 is a simplified diagram illustrating a modification of the device of FIG. 1 in which automatic and random recordings are made at an audio input, are analyzed for musical qualities and are used to form the set of notes for an ad hoc instrument.

Reference is now made to FIG. 7, which is a simplified block diagram illustrating a further preferred embodiment of the present invention. Portable electronic device 90 comprises an audio input 92, and connected thereto a musical quality analyzer 94 which analyzes audio input for musical qualities. Audio excerpts that have identifiable musical qualities are then stored in storage 96. Thus if a particular note is identified in the audio sample then the audio is stored as that particular note. The system attempts to fill up a full set of notes from the audio input and then stores the set of notes as the set of notes for a musical instrument. In other words the system uses regular sound input to define a new instrument on synthesizer 98, which preferably is part of sound card 97. The synthesizer, whether a software or a hardware synthesizer, has a number of instrument modes each for synthesizing a different musical instrument and the audio input simply provides an extra, device-defined, instrument. The output is directed to audio output device 100.

The system illustrated in FIG. 7 may be combined with a device having a camera input as shown in FIG. 6. Randomly or deliberately taken images can be used to illustrate the resulting music file and provide an accompanying video clip. That is to say a system is provided for using images to illustrate the music. As well as still pictures, the same may be carried out with a video camera. It is noted that the recording at the audio input, or for that matter at the camera or video, may advantageously be carried out using an agent or like software device which operates the input in continuous or random fashion.

Figure 8:
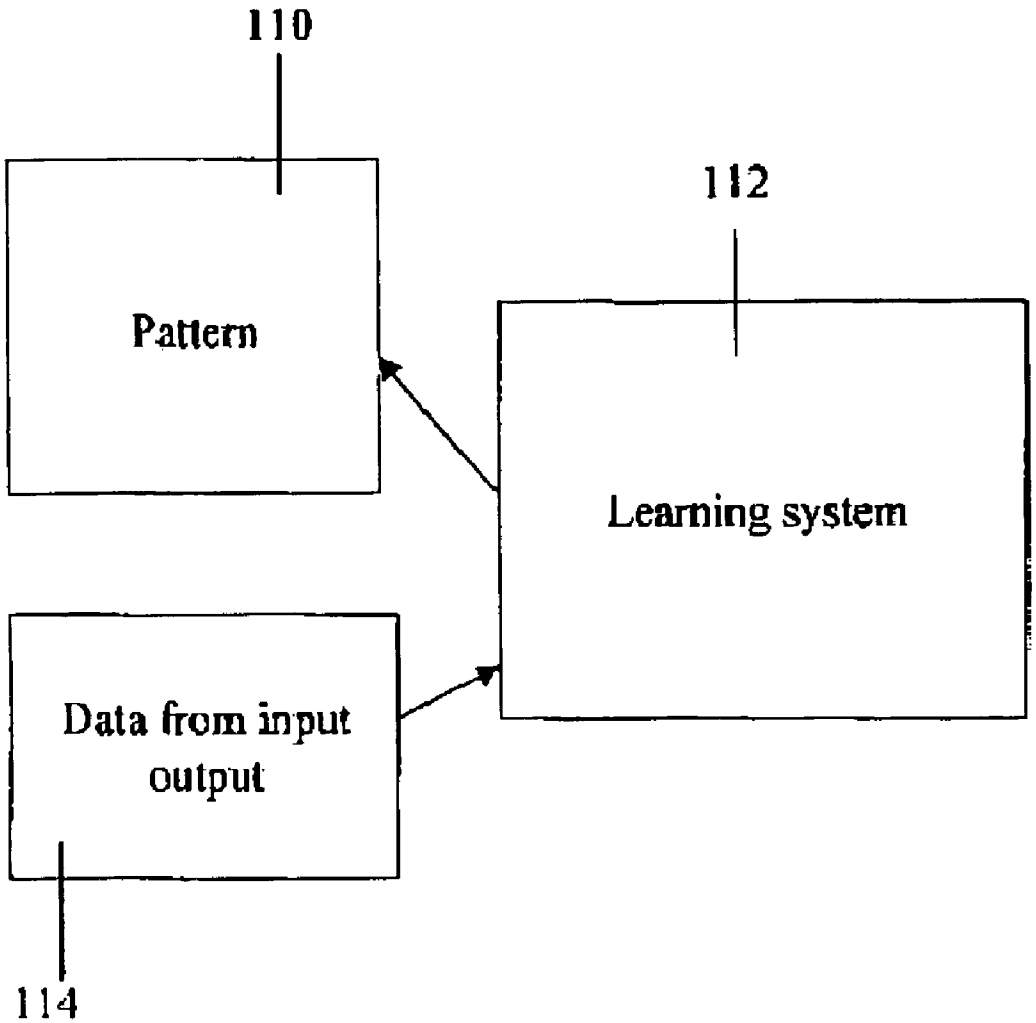
FIG. 8 is a simplified block diagram illustrating a modification of the device of FIG. 1 for applying machine learning techniques to a pattern-based automatic music generation system.

Reference is now made to FIG. 8, which is a simplified block diagram illustrating a further preferred embodiment of the present invention. In the embodiment of FIG. 8 a pattern mode can be set for composing music according to a prestored pattern 110 or according to an arbitrary music generation algorithm. Pattern generation is the process of automatically generating short musical sequences or phrases. Those sequences are merely sequences of notes and articulation data, which can then be played using any synthesis mechanism available. The pattern may be associated with a machine learning system 112 which takes note of data 114 from device inputs and outputs to learn the user's tastes and provide feedback to modify the pattern. In this way it is possible to add sophistication to the original pattern. The machine learning system may for example be a neural network. The result is that the pattern evolves over time, giving the user the feeling of steadily increasing sophistication.

In another embodiment, samples are taken from the environment, say using an autonomous agent which records randomly, to be analyzed for musical characteristics. The samples may subsequently be built into personalized musical compositions by a process involving quantization of the sample, use of a background, and playing of the samples. Gathered samples can be either played as background music, or be used as individual notes, which are fed to a synthesizer to generate audio in response to notes. Such a concept is commonly referred to as wavetable synthesis.

It will be appreciated that the two embodiments, namely pattern generation on the one hand and wavetable synthesis on the other hand, can be used together by for example playing the patterns of the previous embodiment using the resulting synthesizer.

Subsequently, use of artificial intelligence can allow generation of new patterns Generated patterns can be used as building blocks for creation of music. Similarly to the mechanism described above, where the user plays the actual notes in each track, the user can have a more "high-level" control of the track contents, by filling them with the generated patterns, rather than playing the notes himself. For example, the user sets track no. 3 as the active track, and presses one of the keypad keys, which in turn causes the contents of track 3 to be cleared and replaced with a newly generated pattern. Different keys may influence the pattern generation algorithm, for example a specific algorithm may produce a pattern that is more "sad" or "happy" in response to pressing different keys.

Figure 9:
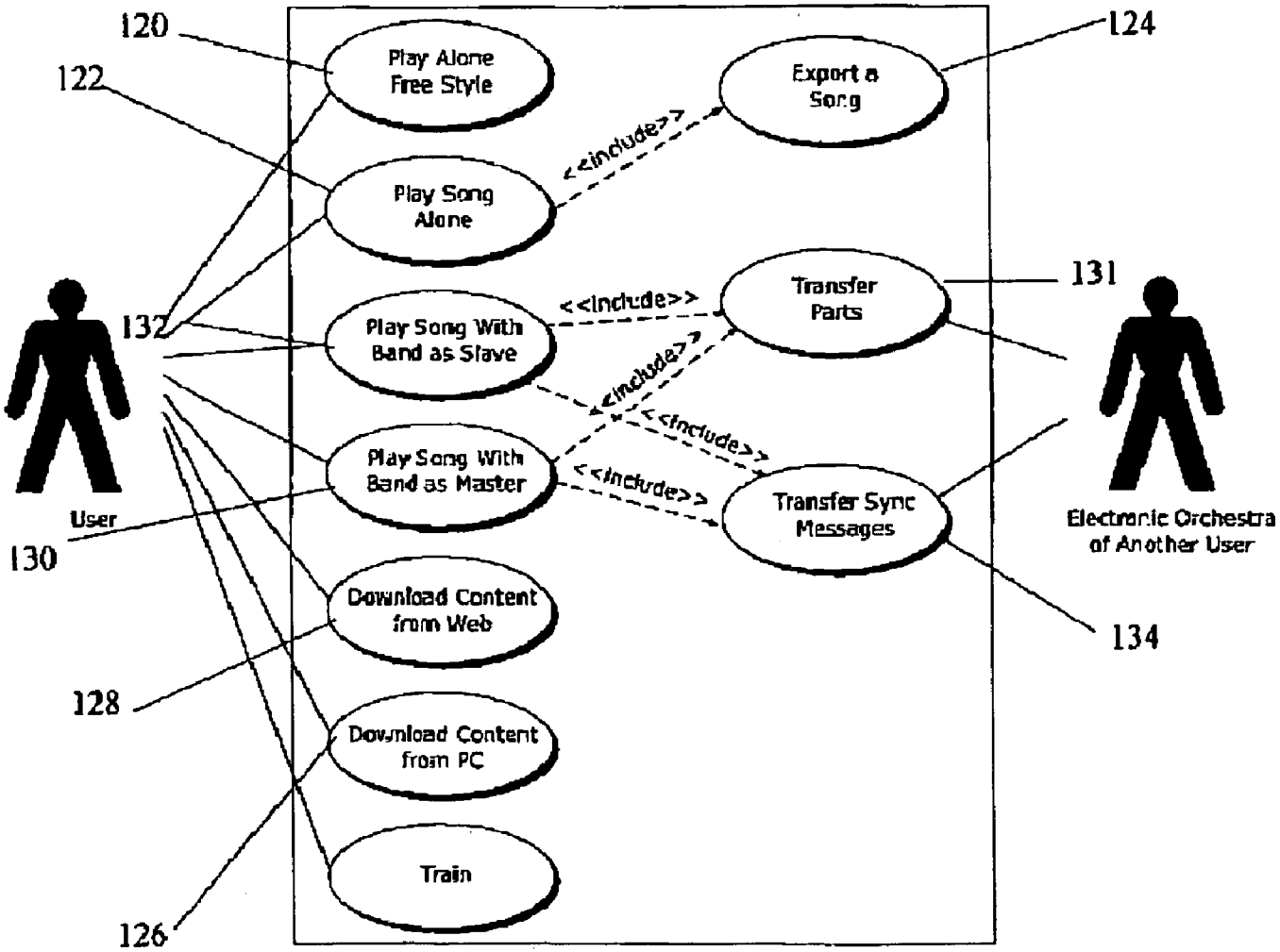
FIG. 9 is a simplified diagram illustrating the different modes for a device according to a preferred embodiment of the present invention which combines the features of the preceding embodiments.

Reference is now made to FIG. 9 which is a simplified state diagram illustrating the different states and modes of a device which incorporates the features of the preceding diagrams. A play alone/freestyle mode 120 allows a user to select an instrument and any other settings he chooses and simply play. A mode 122 for playing a song allows a background track to be played or specific settings to be applied, or both, to which the user can play along. The end result can be exported as indicated by state 124.

Modes 120 and 122 are standalone modes, for which the portable electronic device does not need to be communication enabled. In addition there are four modes which do require communication ability. The first is a mode 126 in which the computer is able to download data from a computer and upload data to the computer, say via a USB port or other suitable link. The data may typically be a music file. Mode 128 is a mode for communicating via a network such as the Internet. Mode 130 is for group playing as the master device, which involves setting up the group, selecting the song to be played and assigning parts to the other users 131. Mode 132 involves group playing as a slave. Both modes 130 and 132 involve synchronizing and sending synchronized information 134.

Figure 10:
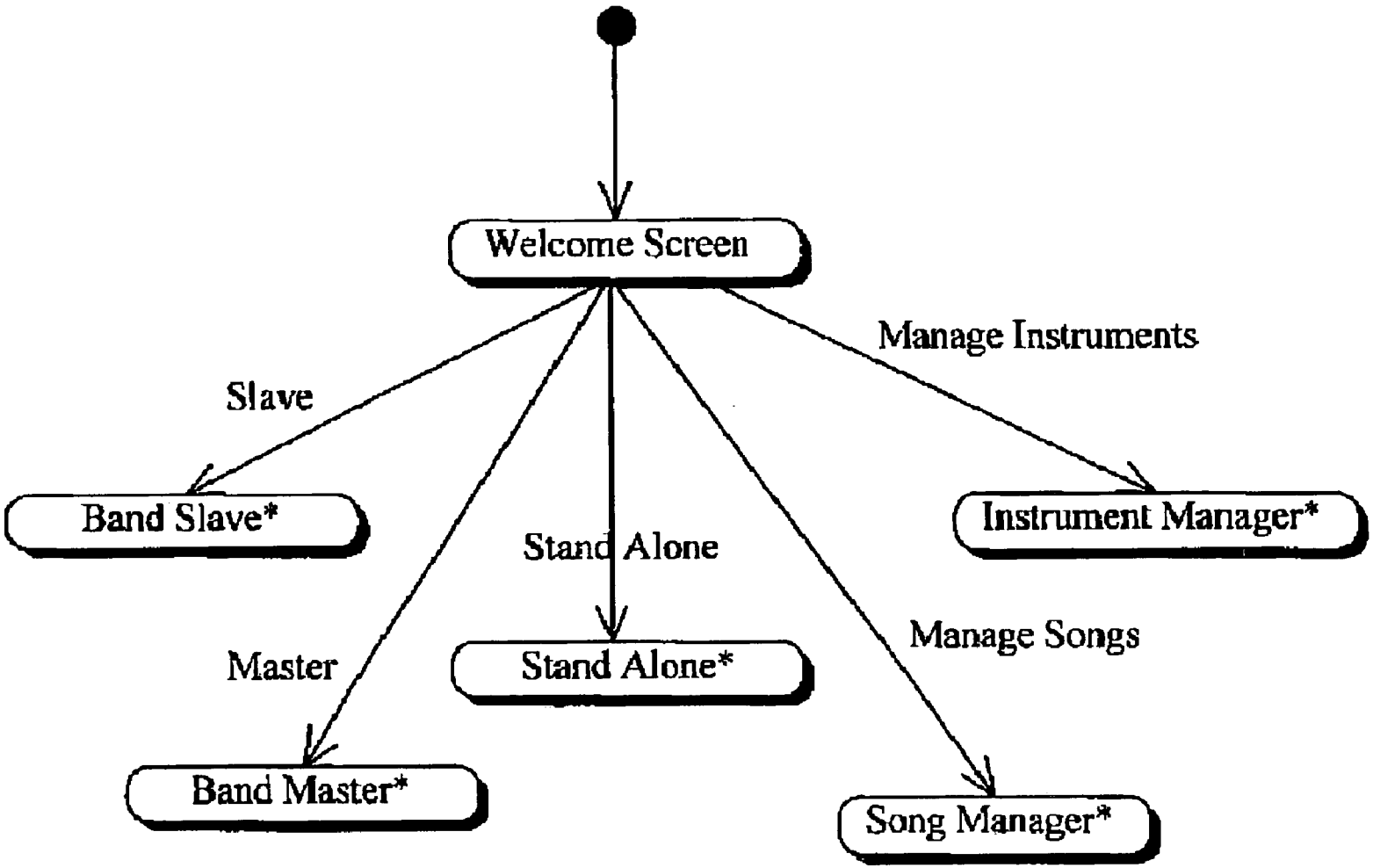
FIG. 10 is a simplified diagram illustrating the modes of FIG. 9 in layered form, starting from a welcome menu, according to a first preferred embodiment of the present invention.
Figure 11:
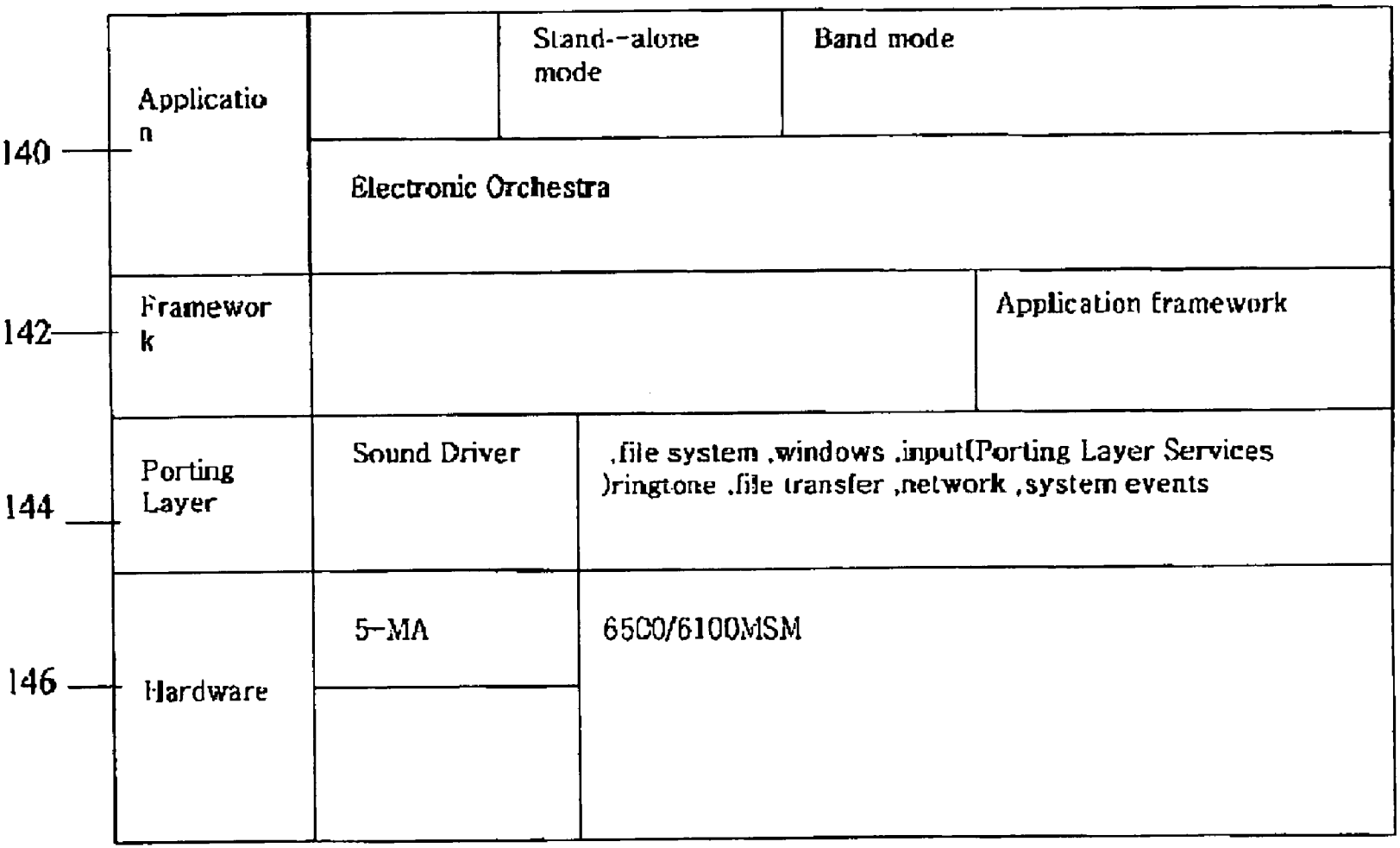
FIG. 11 is a system diagram illustrating the portable electronic device of FIG. 1 as a series of layers.

Reference is now made to FIG. 10, which is a simplified diagram illustrating the device states as a series of screens. A welcome screen starts the proceedings and leads the user to whichever of the modes detailed above he desires to reach. Each screen has a back event that allows the user to return to the previous level. FIG. 11 illustrates the portable electronic device as a series of layers. An application layer 140 has an electronic orchestra application which splits into band mode and standalone mode as explained. A framework mode 142 holds an application framework. A hardware abstraction layer 144 holds the sound driver, input and output, file system and porting layer services. Finally a hardware layer 146 carries the device hardware.

Figure 12:
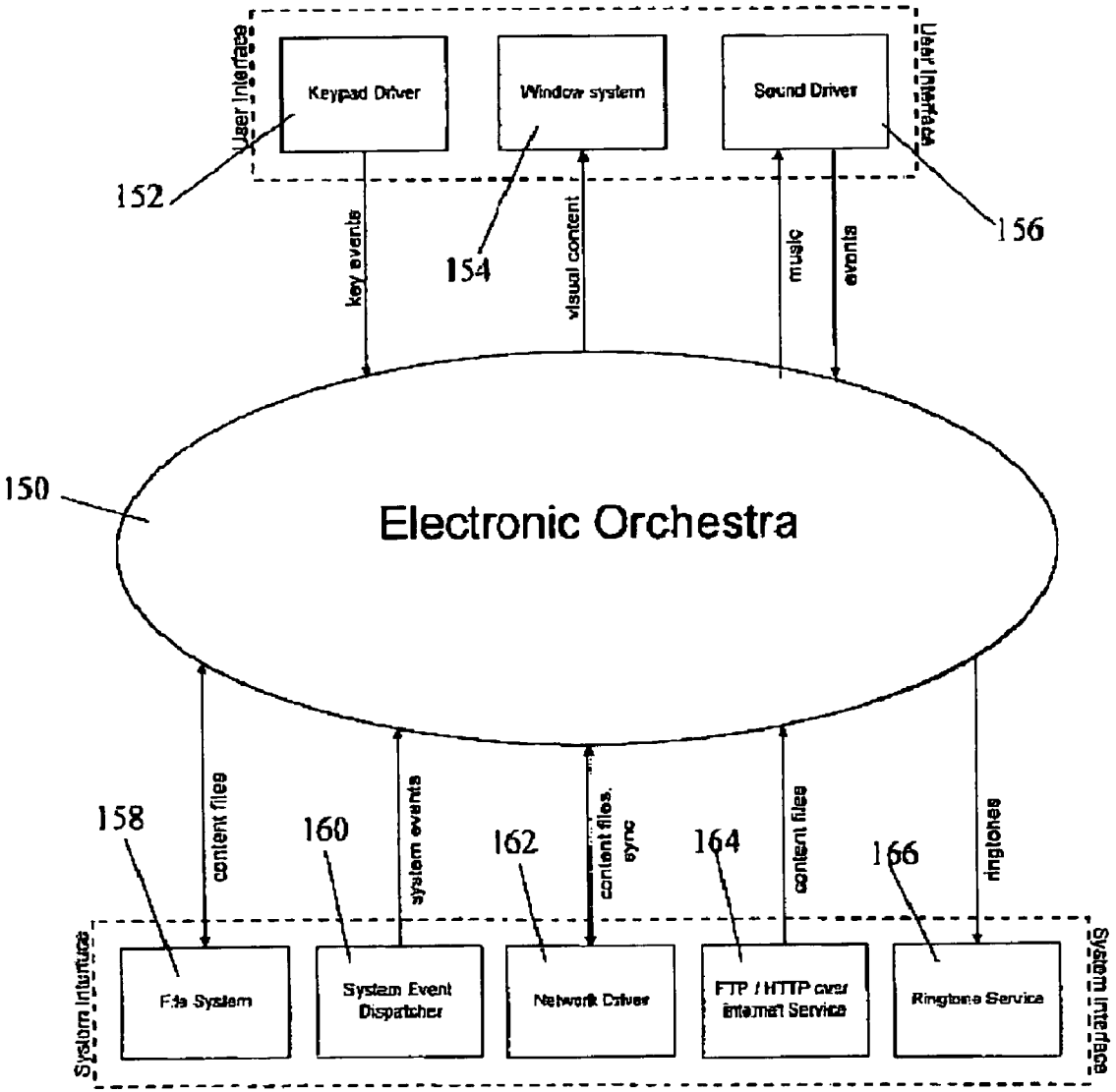
FIG. 12 is a simplified application diagram showing the electronic orchestra application of a preferred embodiment of the present invention and the various systems with which it interacts.

Reference is now made to FIG. 12, which is a simplified diagram illustrating the electronic orchestra application 150 and showing the different systems with which it interacts. The application 150 preferably interacts with the user interface which comprises keypad driver 152, the windowing part of the operating system 154 and the sound driver 156. The application also interacts with the system interface which includes file system 158, the system event dispatcher 160, the system network driver 162, the FTP/HTTP protocol system 164, and the ringtone service 166.

Figure 13:
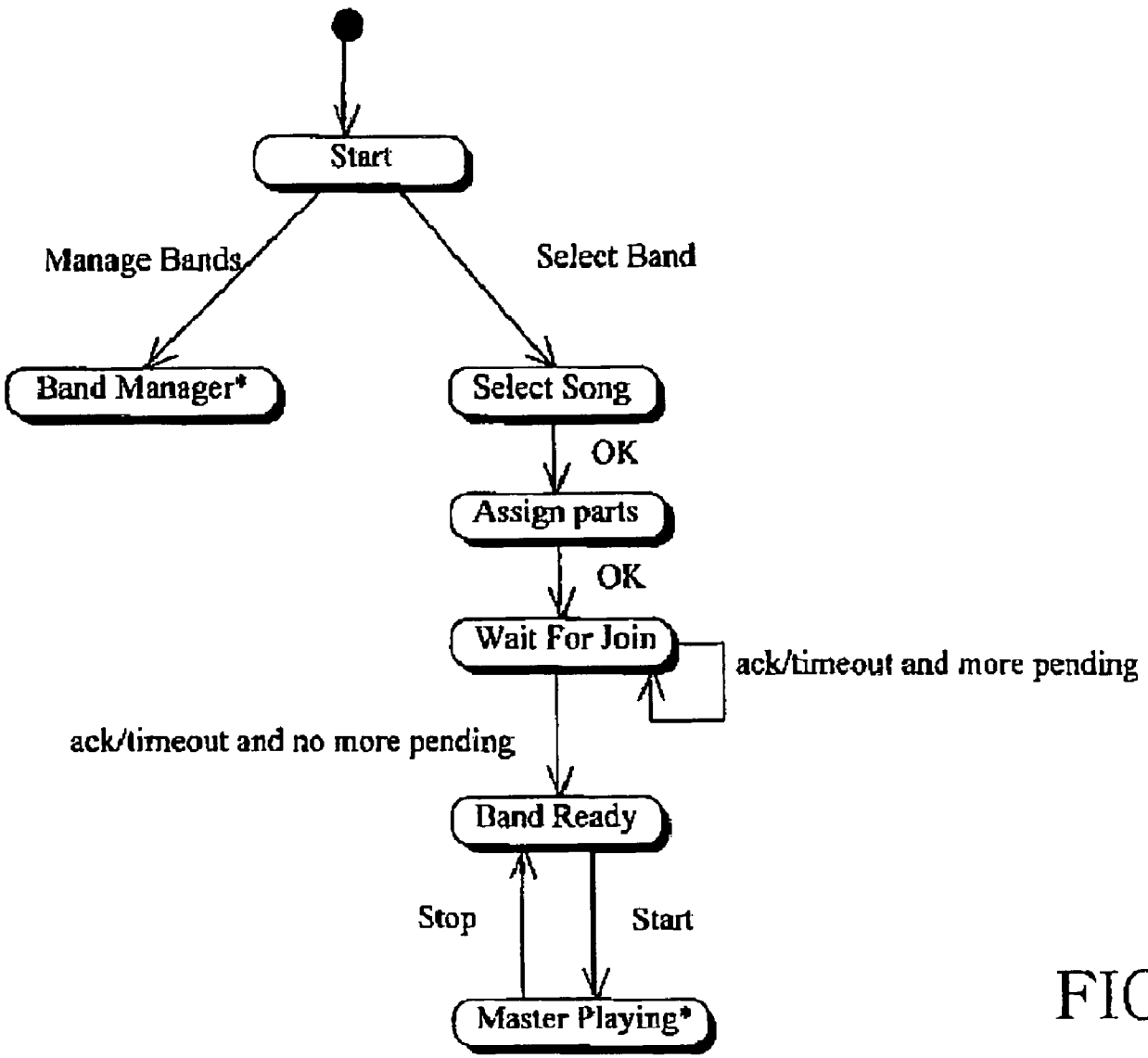
FIG. 13 is a simplified flow chart illustrating operation of a device according to a preferred embodiment of the present invention as a band master.

FIG. 13 is a flow chart illustrating operation of the portable electronic device in band mode as a master. The device can manage its bands in the sense of adding particular devices to a given grouping. It then selects the desired grouping and sends invitations to join a session. A song is selected and parts are assigned. The players acknowledge and playing begins.

Figure 14:
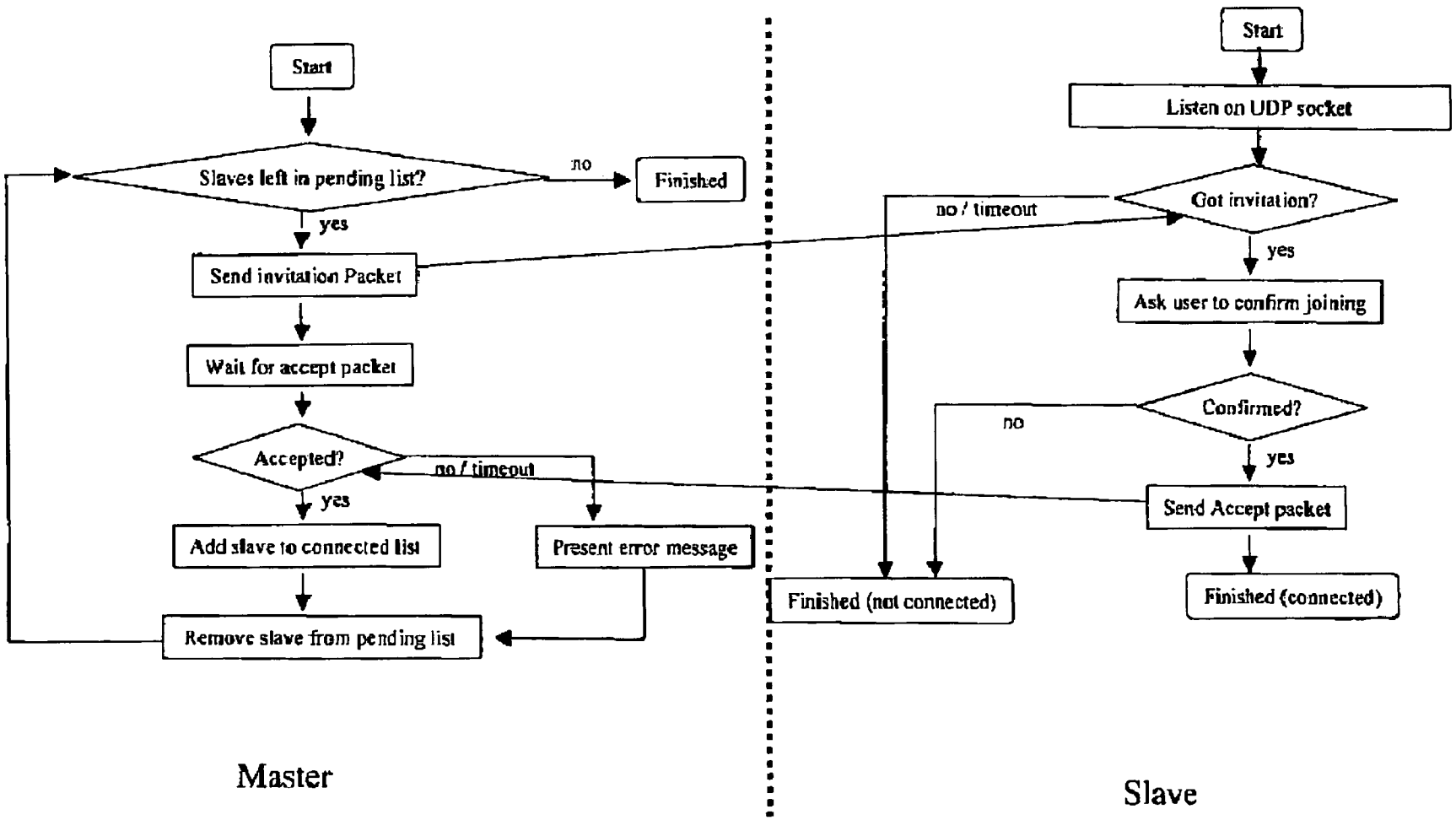
FIG. 14 is a simplified diagram illustrating handshake operation between master and slaves in the band mode.

Reference is now made to FIG. 14 which shows in greater detail the handshake process between master and slaves. For simplicity the illustration shows the handshake being carried out sequentially for each slave, but in practice the different stages are carried out in parallel. If any slaves remain then an invitation packet is sent by the master asking the slave to connect up. The master then waits for an accept packet to indicate that the slave has accepted. If the accept packet is received before a timeout occurs then the slave is added to a list of connected devices and removed from a pending list of slaves waiting to be connected. If a no message is received from the slave or a timeout is reached first then a relevant error message is produced as required and the slave is in any case removed from the pending list. The slave in the meantime listens via its UDP socket and if it receives the invitation it asks the user to confirm joining of the group. If the user confirms then the slave sends an acceptance and continues as a connected party. If at either the invitation or user acceptance stage a timeout is reached, or a no is received from the user in the latter case, then the device remains unconnected.

Figure 15:
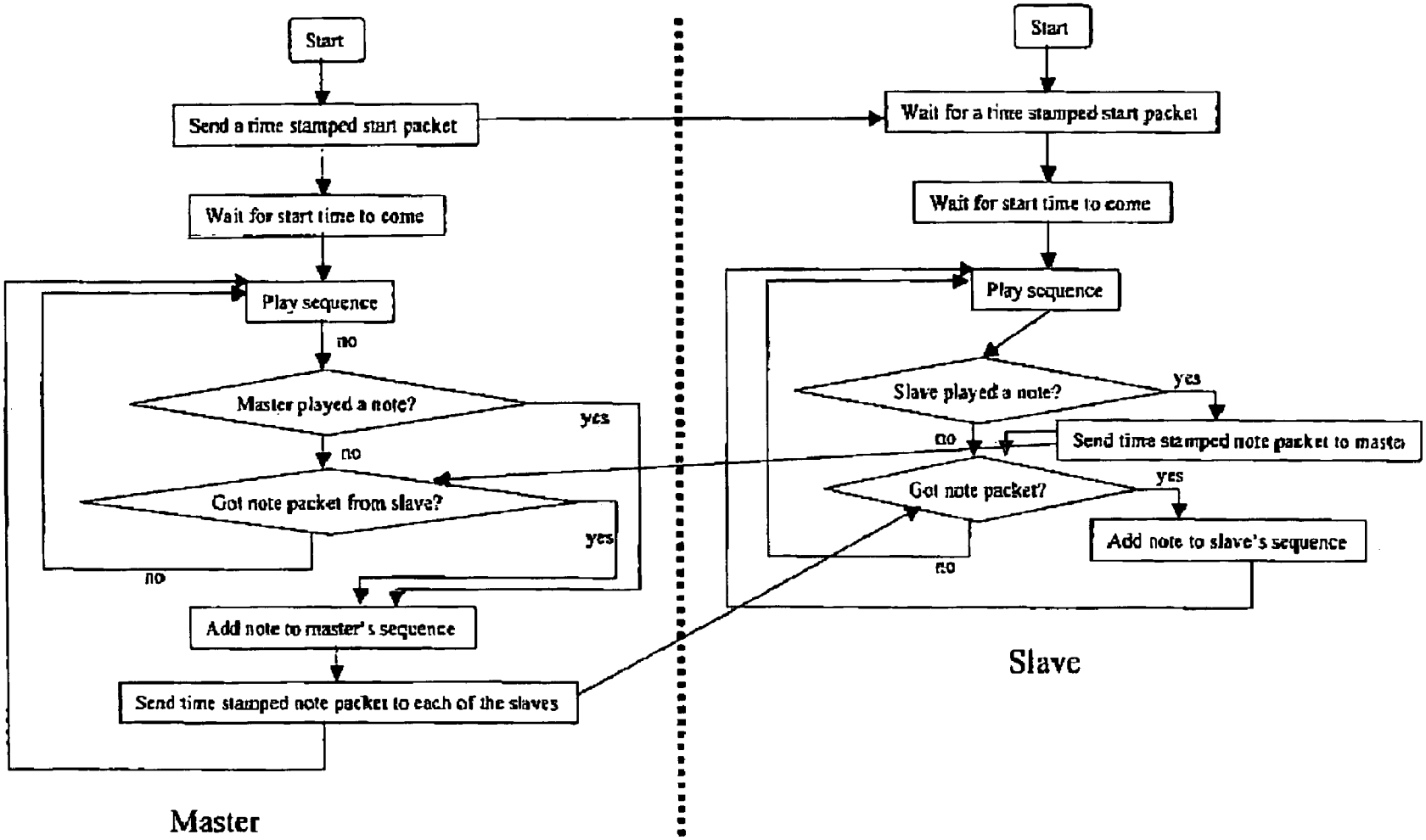
FIG. 15 is a simplified flow diagram illustrating the recording process between master and slaves in the band mode.

Reference is now made to FIG. 15, which illustrates the synchronized playback process between the band members once the slaves have been connected up. The master initially sends a time-stamped start packet which designates a start time. The time is selected so that the packet has time to reach the slaves before the designated start time occurs. Then both master and notified slaves await the designated start time. Now if the slave plays a note then the note is sent as a time stamped note packet to the master. Notes received from the slave as well as notes played locally at the master are added to a master note sequence, and then each note of the master note sequence is sent as a time stamped note sequence to all of the slaves. The slave also has a note sequence but notes are only added to the slave note sequence if they are received from the master. In general the master and each slave are assigned individual tracks of the current music file. The track is preferably cleared every time a corresponding device enters record mode.

At the end of the band session a stop packet is preferably sent to free all the slave devices from the session.

Figure 16:
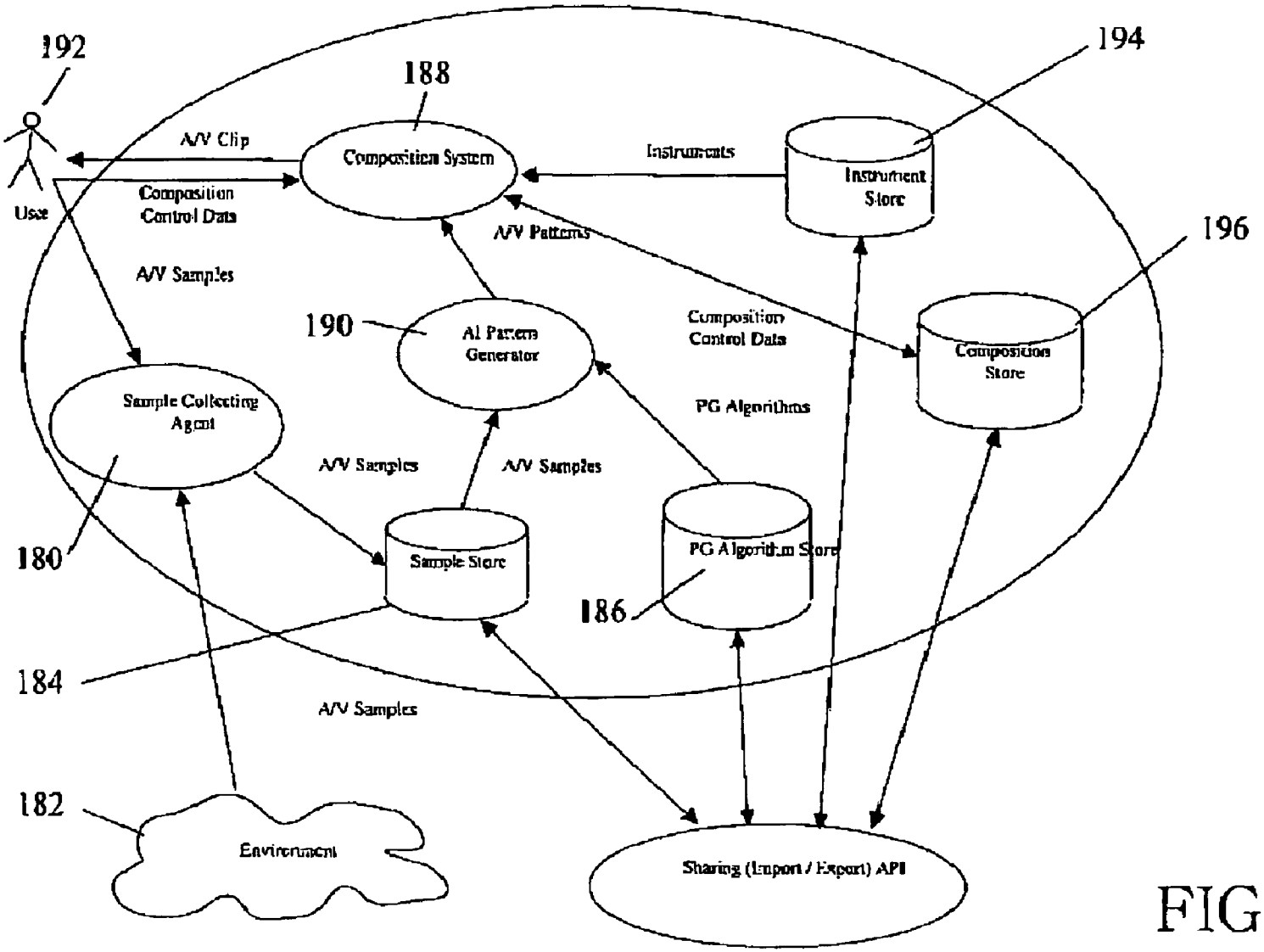
FIG. 16 is a simplified system diagram illustrating in greater detail the use of an electronic orchestra system for the composition of music using user samples.

Reference is now made to FIG. 16 which illustrates the use of the above described electronic orchestra system for the composition of music from user samples. A sample collecting agent 180 collects samples from environment 182. Alternatively samples may be obtained from a sample store 184. The sample store may for example contain shared material obtained over the network.

Pattern generation algorithms are preferably held in a pattern generation algorithm store 186. These too may be obtained via network sharing.

A composition system 188 makes use of an artificial intelligence pattern generator 190, and/or composition control data from a user 192. The composition system also makes use of available instruments from instrument store 194 and produces compositions. The compositions are placed in composition store 196.

Composition store 196 may contain compositions from the composition system 188 or in addition, compositions obtained externally from the network or the like.

Essentially, FIG. 16 shows a top-level design of a system that lets the user compose music and video based on patterns rather than on single notes. These patterns may contains audio/video samples collected by the agent 180 discussed above. The patterns may be generated by an arbitrary algorithm, ranging from a trivial solution based on predefined patterns to more complex algorithms, such as neural networks. The system of FIG. 16 is similar to those detailed above, only that instead of recording single notes, the user edits an entire track in one step, and for example replaces the existing part contained in the track with an artificially generated pattern.

As illustrated in FIG. 16, the system is configured to permit the user to compose music and video based on patterns in addition to single notes. These patterns may contains audio/video samples that have been collected by the agent, as discussed above. The patterns may be generated by an arbitrary algorithm, ranging from a trivial solution based on predefined patterns, to more complex algorithms, such as neural networks. The use of patterns integrates with the functions detailed above, only that instead of recording single notes, the user is now able to edit an entire track in a single step, and can replace an existing part with a generated pattern.

It is expected that during the life of this patent many relevant portable electronic devices, cellular devices and systems will be developed and the scopes of the terms herein, particularly of the terms "portable electronic device", "personal digital assistant" or "PDA" and "communication channel", are intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A portable electronic device having a screen and a numeric keypad for a user, the device comprising:

a sound card for processing sound signals to produce audible musical tones at an audible output of said device;

a musical module, associated with said sound card, for electronically synthesizing musical instruments; and a user interface for interfacing said musical module to the user via said screen and said numeric keypad, said user interface being configured to set a user play mode in which user input at said numeric keypad is played as audio output via said sound card, wherein the musical module, in a play and record mode, musically synchronizes audio output corresponding to said user input at said numeric keypad and a selected music file using musical parameters of said selected music file for an automatic fit between said user input and said selected music file, and simultaneously plays and records said synchronized audio output and said selected music file.

2. The portable electronic device of claim 1, wherein said musical module is a musical synthesizer.

3. The portable electronic device of claim 2, wherein said musical synthesizer is a software synthesizer.

4. The portable electronic device of claim 2, wherein said musical synthesizer is a hardware device.

5. The portable electronic device of claim 1, wherein said user interface is configured to set a play back mode, in which data, from a stored music file or from a communication channel, is played as audio output via said sound card.

6. The portable electronic device of claim 1, wherein said user interface is configured to set a record mode in which the user input is played as audio output via said sound card and recorded in data storage.

7. The portable electronic device of claim 6, wherein said user interface is configured to set the user play mode and the record mode in which data from a stored music file is played as audio output via said sound card and the user input is also played as audio output together with said data from said stored music file.

8. The portable electronic device of claim 7, the musical module further comprising:

a parameter extractor for extracting musical parameters of said stored music file; and a constraint unit associated with said parameter extractor for setting ones of said extracted musical parameters of said stored music file as constraints for said user input, thereby to bring about the automatic fit between said user input and said stored music file.

9. The portable electronic device of claim 8, wherein said parameter extractor is configured to obtain said musical parameters of said stored music file from metadata associated with said file.

10. The portable electronic device of claim 9, wherein said parameter extractor is configured to obtain said musical parameters of said stored music file from an event list within said file.

11. The portable electronic device of claim 1, wherein said user interface comprises a layered menu, respective layers comprising selections at one level between at least two of the play and record mode, the user play mode, and a playback mode, selections at a second level between a plurality of musical instruments to be synthesized, or a plurality of stored files to be played, selections at a third level between standalone play and grouping with other devices, selections at a fourth level between musical keys or musical timings, and selections at a fifth level between musical notes in a selected musical key.

12. The portable electronic device of claim 1, wherein said numeric keyboard is configured with key strike detection that is able to detect velocity of a key strike event, and wherein said musical module is able to use said velocity as a control parameter.

13. The portable electronic device of claim 1, further comprising a cellular communication channel.

14. The portable electronic device of claim 1, wherein said music file is a ring tone file.

* * * * *